US006914383B2

(12) United States Patent
Yamashita et al.

(10) Patent No.: US 6,914,383 B2
(45) Date of Patent: Jul. 5, 2005

(54) LIGHT SOURCE DEVICE

(75) Inventors: Takashi Yamashita, Himeji (JP); Atsushi Imamura, Takasago (JP); Tomoyoshi Arimoto, Tatuno (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 136 days.

(21) Appl. No.: 10/641,009

(22) Filed: Aug. 15, 2003

(65) Prior Publication Data

US 2004/0095069 A1 May 20, 2004

(30) Foreign Application Priority Data

Aug. 20, 2002 (JP) ..... 2002-239679
Apr. 4, 2003 (JP) ..... 2003-101078

(51) Int. Cl.[7] ..... H01J 17/44
(52) U.S. Cl. ..... 313/594; 313/25; 313/26
(58) Field of Search ..... 313/17, 25, 26, 313/493, 593, 634

(56) References Cited

U.S. PATENT DOCUMENTS 5,323,091 A 6/1994 Morris
6,268,698 B1 7/2001 Scholz

FOREIGN PATENT DOCUMENTS

JP 2002-100323 4/2002

*Primary Examiner*—Vip Patel
(74) *Attorney, Agent, or Firm*—Nixon Peabody LLP; David S. Safran

(57) ABSTRACT

A light source device in which the operating characteristic of the auxiliary light source can be improved, in which the starting property within the main discharge vessel is extremely advantageous and which has high reliability with respect to vibration resistance and impact strength without the disadvantage of a cost increase due to the complicated arrangement of the light source device, without reducing the proportion of good articles in the manufacture of the products, and without reducing the quality of the discharge lamp is achieved using a main discharge lamp mounted in a reflector with an auxiliary light source tightly held by the reflector or components which are adjacent to the reflector and without contact with the main discharge vessel.

7 Claims, 10 Drawing Sheets

Fig. 4 (a)
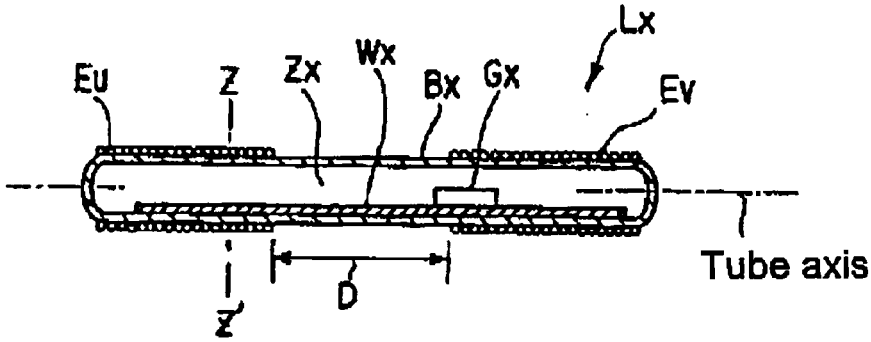
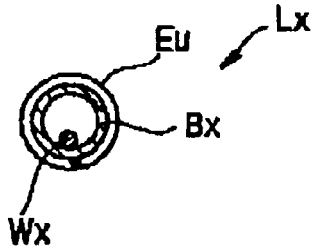
Fig. 4 (b)

LIGHT SOURCE DEVICE

BACKGROUND OF THE INVENTION

1. Field of the Invention

The invention relates to a light source device which is used, for example, as a light source for a projector, and in which a discharge lamp with high radiance (HID lamp), such as a high pressure mercury discharge lamp, a metal halide lamp or the like, is used. The invention relates especially to the starting properties of such a device.

2. Description of Related Art

In a light source device for an optical device, such as a liquid crystal projector, a DLP® projector or the like, a discharge lamp with high radiance which is used as a light source, such as a high pressure mercury discharge lamp, a metal halide lamp or the like, and a reflector with a reflection surface which focuses the radiant light from this discharge lamp and reflects it in the direction toward the front opening are combined with one another and used.

In the above described discharge lamp, it is generally necessary when starting to apply a high voltage in pulse form between the electrodes for the main discharge or between the electrode for the main discharge and the inside of the discharge vessel, to produce an insulation breakdown in the discharge medium within the discharge vessel and to induce a glow discharge or an arc discharge, the plasma electrons which are produced in doing so acting as triggers.

The voltage which is necessary for an insulation breakdown when starting a discharge lamp is generally a few kilovolts in the case in which this discharge lamp is in a temperature state which is roughly similar to room temperature. The voltage necessary for an insulation breakdown in a restart changes, however, depending on the time which has passed since turning off after completion of prior operation, i.e., depending on the temperature of the discharge space. It can be imagined that the reason for formation of such a change lies in the following.

According to the reduction of the temperature of the discharge space after the lamp is turned off, the part of the discharge medium which was gaseous, such as mercury, a halogen and the like, begins to condense. As a result, the composition of the gaseous portion of the discharge space changes, by which the voltage which is necessary for the insulation breakdown changes.

In the case, for example, of a discharge lamp in which mercury and a halogen, such as bromine or the like, and a rare gas, such as argon or the like, are used as the discharge medium, in the case in which, for example, at least 0.15 mg of mercury per cubic millimeter volume of the discharge space (Zd) is contained, the voltage which is necessary for the insulation breakdown after turning off the discharge lamp due to the presence of residual plasma is very low. It does increase rapidly thereafter, but soon begins to drop (roughly 2 minutes under the condition of natural cooling under which the discharge lamp is not subject to compressed air cooling). However, there are cases in which, for example, afterwards, in a restart of roughly five minutes operation after turning off, until finally the temperature of the discharge space drops to roughly 100° C. or less, the breakdown voltage does not stabilize and in which, at the applied high voltage, an insulation breakdown does not occur.

In order to carry out a restart (hot restart) as soon as possible after the lamp has been turned off and to further increase the probability of operation, it is simply enough if the absolute value of the high voltage which is to be applied is fixed to be high. In the case of this measure, there are cases in which different disadvantages occur, such as the formation of an unintentional insulation breakdown by the applied voltage, i.e., the formation of an insulation breakdown of the coating of the insulated cable or the formation of a dangerous phenomenon, such as a creeping discharge or the like, on the connector or the connecting terminal and a malfunction of the electronic circuit of the projector device main part which is caused by noise when the high voltage is applied, and similar disadvantages. If there is a greater spatial distance to increase the insulating property, or if the cable diameter is increased to prevent noise, in order to avoid these disadvantageous phenomena, sufficient space is required for installation in the projector device. Therefore, this measure is not desirable.

With respect to improving the starting property of a discharge lamp, a technology was proposed in which light with short wavelengths, such as UV radiation or the like, is used to accelerate photoemission by the photoelectric effect on the material within the discharge vessel and the ionization of the discharge medium, and to reduce the absolute value of the high voltage which is to be applied when starting. For example, U.S. Pat. No. 5,323,091 (parallel disclosure of the international patent application: WO-A-00/77826) discloses a technology in which bubbles are formed in the discharge vessel of the discharge lamp itself and a secondary discharge chamber is formed which emits UV radiation.

Furthermore, for example, U.S. Pat. No. 6,268,698 (parallel Japanese patent application: JP-OS 2000-173549) proposes a discharge lamp in which on the end face with a hermetic seal arrangement of the discharge lamp an auxiliary UV light source which discharges into open space is installed in one piece. However, in the respective prior art production costs are high because production of the discharge lamp is difficult or otherwise reliability is lacking with respect to the pressure tightness of the discharge lamp.

As generic technology of the invention, the assignee of the present application has devised an invention which does not constitute prior art and which is described in Japanese patent application 2002-2317. The feature of this application lies in eliminating the disadvantages in the prior art and arranging an auxiliary discharge vessel with a main discharge vessel asymmetricly and adjacent to at least one of the sides of the electrode sealing part of the main discharge vessel which closes the main discharge. Here, the overall length of the auxiliary discharge vessel is adjusted to the dimensions of the above described electrode sealing part, and furthermore, the outside diameter of the auxiliary discharge vessel is controlled in such a way that the radiant light flux from the main discharge vessel is not shielded.

Recently, there has also been a great demand for reducing the size and weight of a liquid crystal projector device. Accordingly, it is desired more and more often that the light source device be made smaller. For this purpose, a shortening and a reduction of the overall length of the main discharge vessel are even more required. In order to meet this demand, it is necessary to make the auxiliary discharge vessel even smaller. In the technology which has already proposed by the assignee of the present application, however, according to the reduction in the size of the auxiliary discharge vessel the difficulty of its manufacture becomes greater, by which a reduction of the quality and a cost increase presumably occur. To avoid these problems, a light source device is desired with an arrangement in which the dimensions of the auxiliary discharge vessel need not be adjusted.

In the case in which the above described auxiliary discharge vessel is located directly tightly adjoining the main discharge vessel, this auxiliary discharge vessel is more often exposed to the heat from the main discharge vessel, by which the gas pressure within the auxiliary discharge vessel increases, and thus, the breakdown voltage increases. Starting the discharge within this auxiliary discharge vessel becomes difficult. As a result, there are cases in which the starting property of the discharge lamp is degraded.

Generic technology is described in Japanese patent disclosure document 2002-100323. In this technology, a high pressure discharge lamp and an illumination device are described in which there is a UV radiation source as the starting aid. However, in the technology described in this document, mainly a high pressure discharge lamp or an illumination device is described, with the purpose of space illumination. It is used specifically in the situation in which few vibrations and the like are applied. Therefore, the attachment of the discharge vessel for starting is carried out, for example, only by a conductive body which is wound around the outside of the vessel comprising the UV radiation source. As a result, there is the disadvantage that, for an application in which the device is often moved, such as in a liquid crystal projector device, and in which high reliability with respect to the vibration resistance and impact strength is required, reliability is lacking. Since, in this technology, the distance between the starting aid-UV radiation source and the high pressure discharge lamp is relatively small, often heating from this discharge lamp takes place. Therefore, the process for attachment to a lamp by means of a cement or the like cannot be undertaken, for example.

SUMMARY OF THE INVENTION

A primary object of the present invention is to devise a light source device in which the operating characteristic of the auxiliary light source can be improved, in which the starting property within the main discharge vessel is extremely advantageous. Furthermore, it is also an object to attain such a light source device which has high reliability with respect to vibration resistance and impact strength without the disadvantage of a cost increase due to a complicated arrangement of the light source device, and without increasing the proportion of defective articles resulting during manufacture of the products without reducing the quality of the discharge lamp.

According to a first aspect of the invention, in a light source device in which, within the main discharge vessel of a discharge lamp which is filled with a discharge medium for the main discharge, there is a pair of opposed electrodes for the main discharge, a first electrode sealing part and a second electrode sealing part being connected to the above described pair of main discharge electrodes, which furthermore has a reflector which reflects the radiant light from the discharge lamp by means of a reflection film which has been formed on its inside and which emits the light in a direction toward a light exit window which is formed in front of the reflector, and in which there is a starting electrode in addition to the electrodes for the main discharge outside the main discharge vessel, the objects are achieved by the auxiliary light source, which has an auxiliary discharge vessel filled with a discharge medium for an auxiliary discharge, and a first outside electrode which is located on the outside of the auxiliary discharge vessel and moreover is electrically connected to the starting electrode, being non-integral with the main discharge vessel and held by the reflector and/or by parts which are adjacent to the reflector.

The objects are also advantageously achieved in that the above described auxiliary discharge vessel is located in the vicinity of the edge area of the opening in front of the above described reflector.

Furthermore, the objects are advantageously achieved in that, in the above described reflector, a translucent window component is installed such that the above described edge area of the opening is closed and that the above described auxiliary discharge vessel is installed between this window component and the above described reflector.

The objects are moreover advantageously achieved in that, in the neck area of the above described reflector, a base is installed and that the above described discharge vessel is held by this base.

Still further, the objects are achieved in that the above described auxiliary discharge vessel is located on the outside of the above described reflector.

The objects are also achieved in that, on the outside of the auxiliary discharge vessel of the above described auxiliary light source, there are a first outside electrode and a second outside electrode at a distance relative to one another and that the following relationships are satisfied: where A (kV) is the starting voltage of the above described auxiliary light source and D (mm) is the distance between the first outside electrode and the second outside electrode:

$$A \leqq D \leqq 15A.$$

The invention is further described below using several embodiments shown in the drawings.

BRIEF DESCRIPTION OF THE DRAWINGS

FIGS. 4(*a*) & 4(*b*) each show a schematic cross section of an auxiliary light source Lx which is cut by the tube axis;

FIG. 8(*b*) is a schematic cross-sectional view taken along line Y—Y in FIG. 7;

DETAILED DESCRIPTION OF THE INVENTION

Figure 1:
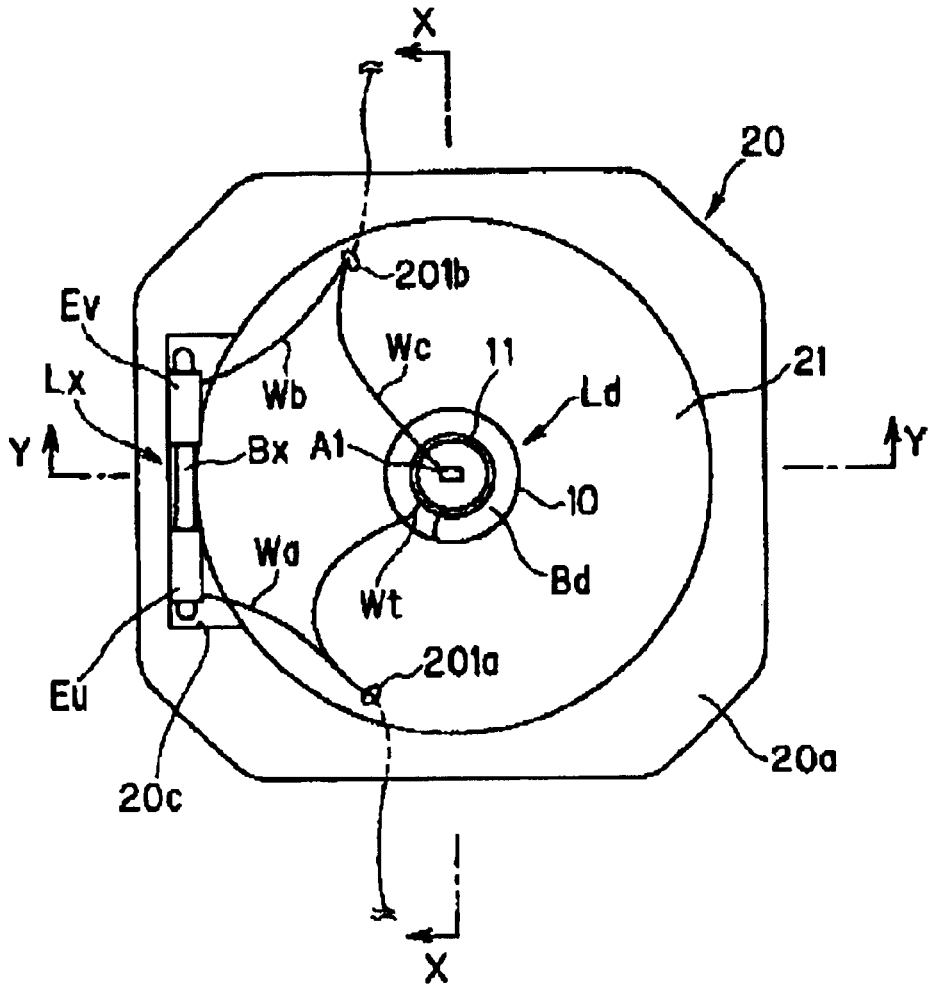
FIG. 1 is a schematic front view of a light source device.
Figure 2:
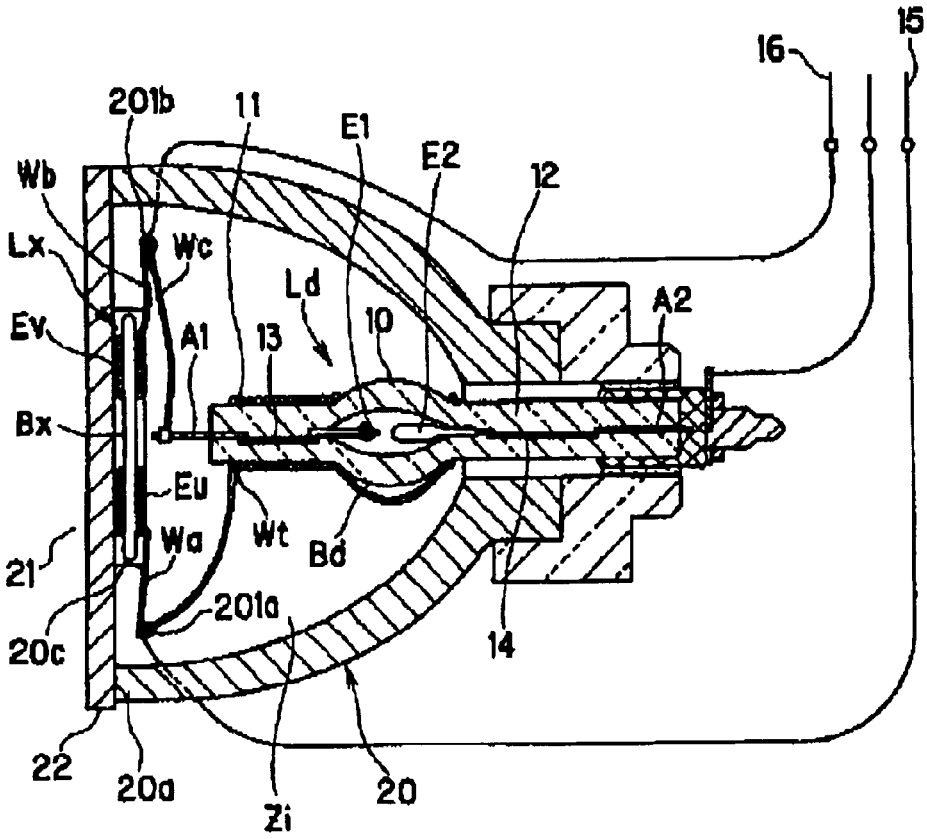
FIG. 2 is a schematic cross-sectional view taken along line X—X in FIG. 1.
Figure 3:
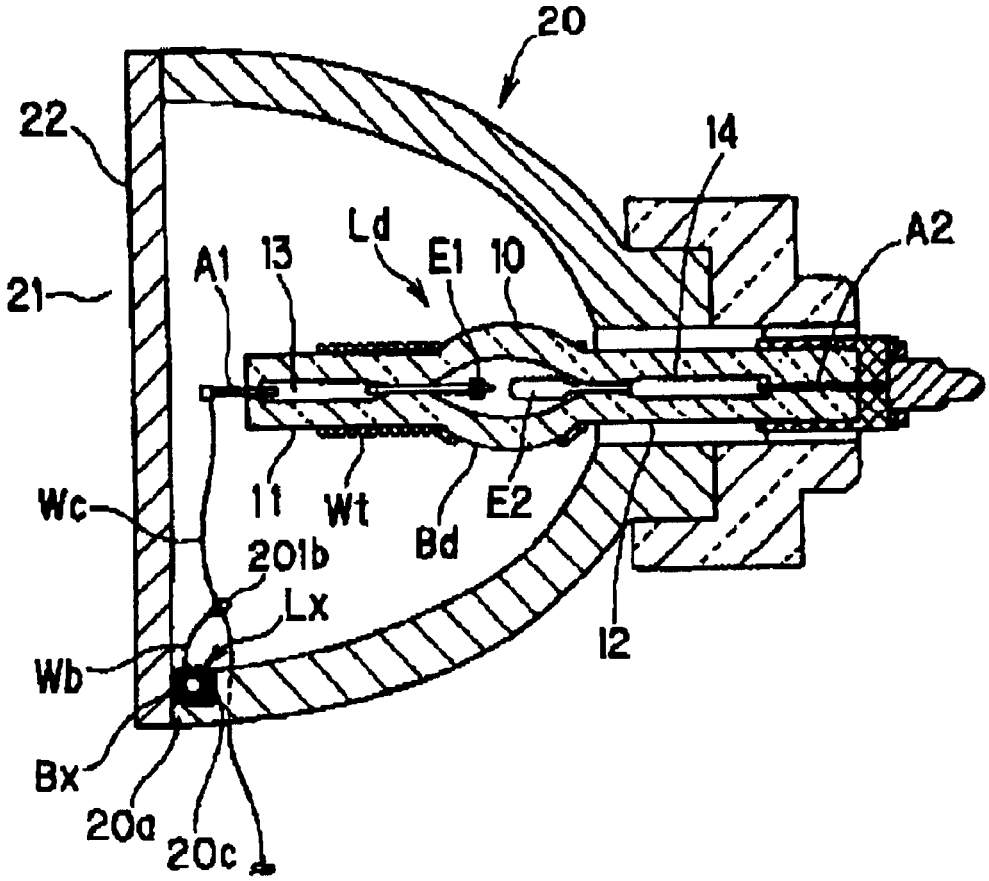
FIG. 3 is a schematic cross-sectional view taken along line Y—Y in FIG. 1.

In FIGS. 1 to 3, the main discharge vessel Bd of the discharge lamp Ld is made of silica glass, is formed to be essentially oval and has an arc tube part 10 which forms the main discharge space. Within this arc tube part 10, there is a pair of opposed electrodes for the main discharge, specifically the main discharge electrode E1 on the cathode side and the main discharge electrode E2 on the anode side. Sealing parts 11, 12, for the respective electrodes extend from the opposite ends of the arc tube part 10. Conductive metal foils 13, 14, which normally are made of molybdenum, are hermetically sealed in these electrode sealing parts 11, 12. The base parts of the upholding parts of the electrodes, which have the electrodes E1, E2 on their tips, are welded on the ends of these metal coils 13, 14 and are electrically connected. On the other end of the metal foil 13, and on the other end of the metal foil 14, on the one hand, an outer lead pin A1, and on the other hand, an outer lead pin A2 which project to the outside are welded.

The arc tube part 10 is filled with given amounts of mercury, a rare gas and a halogen gas.

The mercury is used to obtain the required wavelength of the visible radiation, for example, to obtain light with wavelengths from 360 nm to 830 nm, and is added in an amount of at least 0.15 mg/mm$^3$. This added amount differs depending on the temperature condition. However, during operation an extremely high vapor pressure of at least 100 MPa is reached. By adding a larger amount of mercury, a high pressure mercury lamp with a high mercury vapor pressure during operation of at least 200 MPa or at least 300 MPa can be produced. The higher the mercury vapor pressure becomes, the more suitable a light source for a projector device can be implemented.

The rare gas contributes to improving the operating starting property, and for example, roughly 13 kPa of argon gas is added as the rare gas.

The added halogens can be iodine, bromine, chlorine and the like. The amount of halogen added can be chosen, for example, from the range from $10^{-6}$ to $10^{-2}$ $\mu$mole/mm$^3$. The function of the halogen is to prolong the service life of the tungsten electrodes using the halogen cycle.

The numerical values of such a mercury high pressure lamp are shown below by way of example:

For example:

the maximum outside diameter of the emission part is 11.3 mm;

the distance between the electrodes of 1.2 mm;

the inside volume of the arc tube is 116 mm$^3$;

the wall load is 1.5 W/mm$^2$;

the rated voltage is 80 V; and the rated wattage is 200 W.

This mercury high pressure lamp is installed in a presentation apparatus, such as the above described liquid crystal projector, an overhead projector or the like, and can provide radiant light with good color reproduction.

In the edge area 20*a* of the opening of the reflector 20, a translucent window component 22 is attached by means of a cement or the like, such that a light exit window 21 is covered. On the inside of the reflector 20, a reflection surface is formed which is made, for example, of a dielectric multilayer film and which has a reflection property with respect to visible radiation. On the inside of the edge area 20*a* of the opening for the reflector 20, a grooved area 20*c* is formed which projects outwardly. Between the above described window component 22 and the edge area 20*a* of the opening of the reflector 20, a discharge vessel Bx of an auxiliary light source Lx is installed by engagement and fixed or is attached by means of a cement. The discharge vessel Bx of this auxiliary light source Lx is arranged such that it projects into the interior Zi of the reflector so that is lies at least opposite the main discharge vessel Bd.

The auxiliary light source is further described below using FIGS. 4(*a*) & 4(*b*).

FIG. 4(*a*) shows a cross section of the auxiliary discharge vessel in the direction of the tube axis. FIG. 4(*b*) shows a cross section through the tube along line Z–Z' in FIG. 4(*a*). In these figures, the auxiliary discharge vessel Bx of the auxiliary light source Lx has at least partial translucency to UV radiation with short wavelengths. A suitable material is silica glass.

On the two ends of this auxiliary discharge vessel Bx, there is a pair of electrodes on their outside surfaces, especially a first outside electrode Eu and a second outside electrode Ev, opposite one another. If a voltage is applied between this pair of outside electrodes Eu, Ev, by electrostatic coupling within the auxiliary discharge space Zx, a dielectric barrier discharge is induced, by which an auxiliary discharge is started. The auxiliary discharge vessel Bx is formed, for example, of a narrow glass tube with the two hermetically sealed ends, with a total length of roughly 15 mm, an outside diameter of roughly 3 mm and a thickness of roughly 0.8 mm. As the discharge medium, this glass tube is filled with at least one type of gas, such as nitrogen or helium or the like, and a rare gas, such as argon, xenon, neon and the like. Specifically, roughly $1\times10^2$ to $5\times10^4$ Pa of argon, preferably roughly $1\times10^3$ Pa of argon is added. It is advantageous for the overall length of the auxiliary discharge vessel in the axial direction of the tube to be at most 70 mm. The reason for this is the following:

If the length of the auxiliary discharge vessel is greater than 70 mm, the auxiliary discharge vessel can no longer be accommodated in the reflector 20; this can no longer be used to reduce the size of the light source device.

The material for the outside electrodes Eu and Ev is a material with a good antioxidation property and good resistance to thermal shock at a high temperature, such as stainless steel, canthal (iron-chromium alloy), due to the especially outstanding antioxidation property and especially outstanding resistance to thermal shock at a high temperature, canthal being optimum. The length with an outside electrode in the axial direction of the tube is, for example, 0.5 mm to 5.0 mm. It is produced, for example, such that the outside surface of the auxiliary discharge vessel Bx is helically wound with a stainless steel wire with a diameter of 0.3 mm, directly tightly adjoining it. This above described helical outside electrode is formed, for example, such that a coil is produced by winding the stainless steel wire and it is located at a given location of the auxiliary discharge vessel Bx.

It is more advantageous, the larger the surface of the outside periphery of the auxiliary discharge vessel Bx that is covered by the outside electrodes Eu, Ev, since the electrostatic capacitance between the outside electrodes Eu, Ev becomes great, and because the starting of discharge is facilitated. Therefore, it is advantageous that there is a wide area to the extent in which the insulating distance between the outside electrodes Eu, Ev can be ensured.

If, as in the above described version, the distance between the outside electrodes Eu, Ev is designated D (mm) and the starting voltage of the auxiliary light source is designated A (kV), in the case in which the auxiliary discharge vessel Ex is cylindrical, and in the case in which the outside electrodes Eu, Ev are formed in the overall peripheral direction of the outside periphery thereof, maintenance of the relationship $A \leqq D \leqq 15A$ ensures emission within the auxiliary discharge vessel Bx without faulty discharge of the auxiliary discharge vessel Bx on the outside surface. Specifically, the values D=5 mm to 75 mm is advantageous if the voltage (A) is 5 kV.

Figure 5:
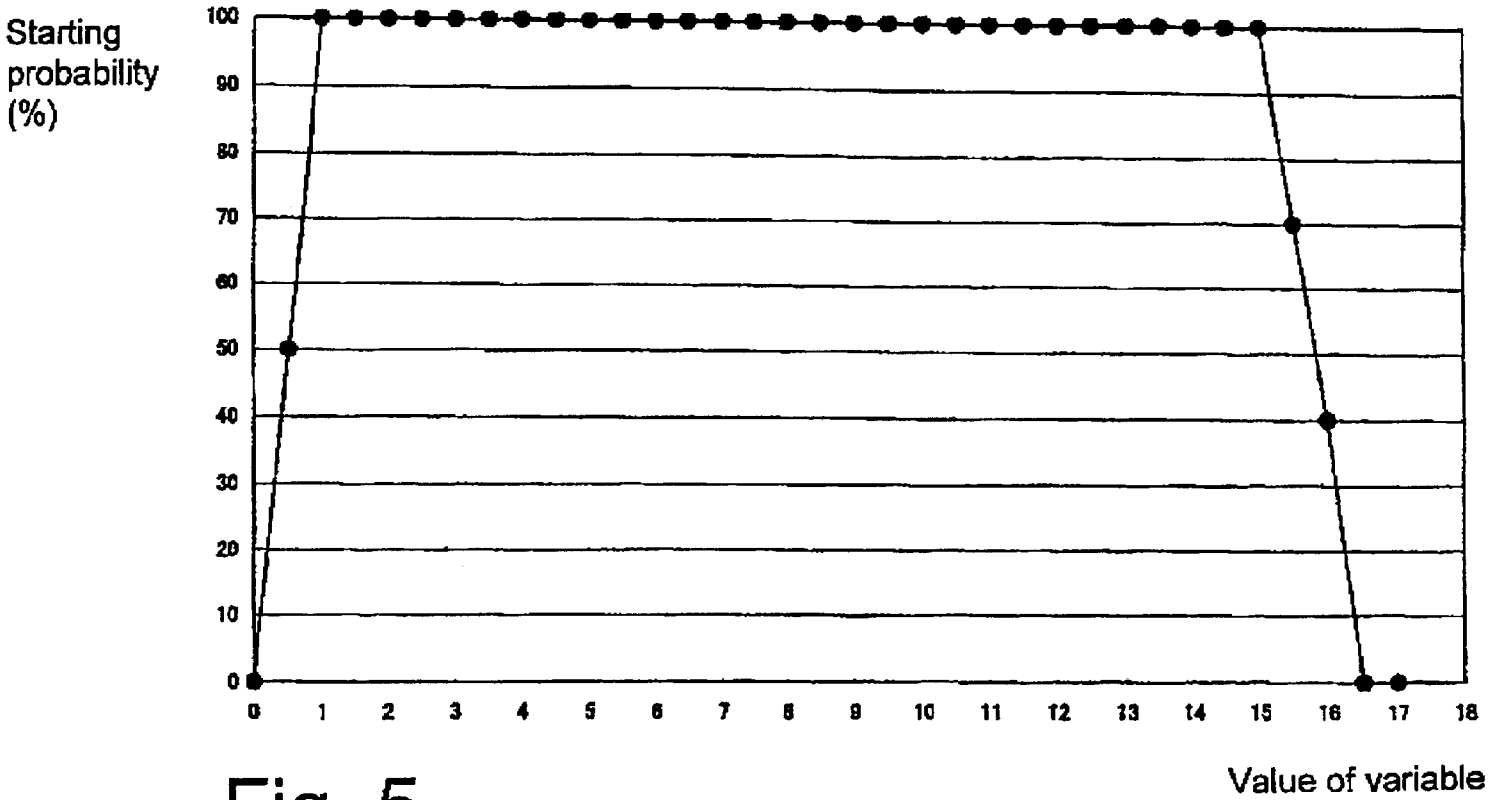
FIG. 5 is a graph of experimental data in which the distance between the outside electrode and the starting probability of the auxiliary light source were studied.

FIG. 5 shows experimental data for which the distance between the outside electrodes and the starting possibility of the auxiliary light source were examined.

For this test, the auxiliary light source which is shown in FIG. 4(*a*) & 4(*b*) was used in which, between the outside electrodes Eu, Ev, a voltage of 5 kV was applied. In doing so, the x axis plots values of the variable of "5 kV x variable" as the distance (mm) between the outside electrodes, and the y-axis plots the starting probability in %.

As is apparent from FIG. 5, for a variable of less than "1," i.e., at a distance between the outside electrodes of less than 5, there are cases in which the phenomenon of leakage of the voltage which has been applied between the outside electrodes occurs and in which the starting probability does not reach 100%. On the other hand, for a variable of greater than "15," i.e., at a distance between the outside electrodes of greater than 75 mm, there are cases in which, in the auxiliary discharge vessel of the auxiliary light source, an insulation breakdown does not occur and in which the starting probability does not reach 100%.

As is apparent from this result, it is advantageous that the value of the variable of "5 kV X variable" as the distance between the outside electrodes is greater than or equal to 1 and less than or equal to 15, and that the distance between the outside electrodes is in the case of application of a voltage of 5 kV between the outside electrodes is greater than or equal to 5 mm and less than or equal to 75 mm.

FIG. 5 shows experimental data in the case of a voltage of 5 kV which is applied between the outside electrodes. But in the range of the applied voltage from 1 kV to 10 kV a result was obtained which exhibits the same tendency. In the range of a voltage from 1 kV to 10 kV which is applied between the outside electrodes Eu and Ev, the auxiliary light source can be reliably operated if the relationship $A<D<15A$ is maintained, where D (mm) is the distance between the outside electrodes Eu, Ev and A (kV) is the starting voltage of the auxiliary light source.

In the case of the starting voltage of less than 1 kV, the voltage is too low; this leads to difficulty in inducing an insulation breakdown within the auxiliary discharge vessel. If the starting voltage exceeds 10 kV, the above described starter must be used which has a very different arrangement and which is a type which is other than the starter which is used advantageously for the light source device of the present invention. As a result of the limitation with respect to the arrangement of the starter, therefore, a voltage of more than 10 kV is never applied.

Whether an insulation breakdown within the auxiliary discharge vessel Bx takes place easily or not is furthermore influenced by the area which is formed by the outside electrodes Eu, Ev.

Specifically, it is desirable in the auxiliary light source shown in FIGS. 4(*a*) & 4(*b*) that the length of the outside electrodes Eu, Ev in the axial direction of the tube is at least 1.5 mm. At a length of the outside electrodes Eu, Ev in the axial direction of the tube of less than 1.5 mm, the area which is formed by the outside electrodes becomes small, by which the electrostatic capacitance which is stored between the outside electrodes is reduced, by which furthermore the electrical energy which is supplied to the auxiliary discharge vessel Bx is reduced and by which an insulation breakdown within the auxiliary discharge vessel Bx is made more difficult. Conversely, if the length of the outside electrodes Eu, Ev in the axial direction of the tube is too great, the disadvantage occurs that the distance between the outside electrodes on the auxiliary discharge vessel can no longer be adequately ensured and that, therefore, a breakdown of the discharge occurs between the electrodes. Therefore, the length of the outside electrodes Eu, Ev in the axial direction of the tube is chosen in accordance with the above described relationship of the distance D (mm) between the outside electrodes to the starting voltage A (kV) of the auxiliary light source is provided in accordance with $A \leqq D \leqq 15A$.

The arrangement of the outside electrodes Eu, Ev is not limited to the above described arrangement, but can be changed in a suitable manner. It can, for example, be formed, as was described above, by helical winding of a wire, by winding of a metal foil or a net-like metal or by clamping with leaf-like metals. An adequate material is one with an outstanding antioxidation property and outstanding resistance to thermal shock at a high temperature. Besides the above described stainless steel, an iron-chromium alloy, nickel or the like can also be used.

The auxiliary discharge vessel Bx is arranged without contact with the main discharge vessel Bd. Therefore, there is hardly any heat effect from this main discharge vessel Bd on the auxiliary discharge vessel Bx. Therefore, a suitable conductive cement or the like can be used. In order to increase the tightly adjoining property between the outside electrodes Eu, Ev and the auxiliary discharge vessel Bx, a conductive cement can also be used.

The above described auxiliary discharge vessel Bx is filled with an internal trigger Wx which is made, for example, of a metallic rod material, a piece of foil or the like. The internal trigger Wx distorts the electrical field of the auxiliary discharge space Zx within the auxiliary discharge vessel Bx, locally produces a high electrical field, and as a result, produces a discharge at a relatively low voltage.

It is advantageous that the internal trigger Wx has a greater overall length than the distance between the electrodes (D (mm)) in order to bridge within the auxiliary discharge vessel Bx from one outside electrode Eu to the other outside electrode Ev. Furthermore, it is more effective for reducing the breakdown voltage if the internal trigger Wx is in contact with the inside wall of the auxiliary discharge vessel Bx which is opposite the outside electrodes Eu, Ev. Thus, variances of the value of the breakdown voltage can be prevented.

Instead of the above described metallic wire material, the internal trigger Wx can also be graphite, carbon nanotubes, silicon pieces or powder or the like. There is also no requirement to add the above described component, and instead, a metal, a dielectric or the like can also be applied or plated in a suitable manner to thus obtain the same effect.

Furthermore, it is advantageous that, within the above described auxiliary discharge vessel Bx, a getter material Gx formed of a metallic component, such as zirconium (Zr), titanium (Ti) or the like is added. According to the repetition of the discharge of the auxiliary discharge vessel Bx, impurity gases, such as H, OH or the like, are emitted from the inside surface of this auxiliary discharge vessel Bx. By absorption of these impurity gases by the above described getter material Gx, the value of the breakdown voltage of the auxiliary light source Lx can be kept low until the end of the service life. Thus, facilitation of starting of this auxiliary light source Lx is ensured. For example "STHGS/WIRE/NI/0.6-300" (code SE 1014) (getter "St101-505") from SAES can be advantageously used as this getter material.

The auxiliary discharge vessel Bx can also be filled with mercury for purposes of obtaining the Pennings effect. Here, an extremely small amount of mercury is sufficient, for example, roughly $5\times10^{-3}$ mg/mm$^3$. In the case of adding this extremely small amount of mercury to the discharge vessel, it is possible to proceed relatively easily and with good workability if, for example, the above described "STHGS/WIRE/NI/0.6-300" (code SE 1014) from SAES with a length of roughly 1 mm is cut, added and the mercury contained in it is allowed to emit after addition to the discharge vessel by heating.

A line Wa is connected to the outside electrode Eu in the auxiliary light source Lx, electrically connected to the starting electrode Wt which is located in the outside peripheral area of the main discharge vessel Ld and is moreover diverted through an opening 201*a* formed in the reflector 20 out of the latter. Furthermore, a line Wb is connected to the outside electrode Ev, electrically connected to a line Wc which is connected to the electrode E1 on the cathode side for the main discharge vessel Bd and is moreover diverted through another opening 201*b* formed in the reflector 20 out of the latter. These lines Wa and Wb, which were diverted from the reflector 20, are connected to the current feed lines of an outside current source (not shown) by terminals 15, 16 which are located outside of the reflector 20.

It is desirable for the lines Wa, Wb and the starting electrode Wt to withstand the current and the operating temperature and for them to be so thin that there is no loss of light flux. For example, in the case in which the rated power consumption of the discharge lamp Ld is 100 W to 300 W, it is desirable for the wire diameter to be at most 0.5 mm, and it is advantageous, here, that nickel is used as the material.

Furthermore, it is desirable that, on the outside of the reflector 20, the lines are coated with silicon or the like as the insulation coating. Additionally, the entire reflector can also be coated using a heat-shrinkable tubing or the like in order to enhance the insulation property between the light source device and the surrounding structure.

Starting operation in the discharge lamp is further described below using the light source device described above in the first version.

The starting electrode Wt is, as was described above, formed in the vicinity of the border areas between the arc tube part 10 of the main discharge vessel Bd and the electrode sealing parts 11, 12 of the main discharge electrodes E1, E2.

The high voltage generation part of a feed device, comprised of a high voltage transformer and the like, is connected such that a high voltage is applied between the conductive wire which forms the starting electrode Wt and for example the outer lead A1 on the cathode side.

When the discharge lamp Ld is started, in the state in which a no-load voltage is applied between the outer leads A1, A2 as the two poles, a high voltage is applied between the starting electrode Wt and the outer lead A1 on the cathode side. In this way, between the inside of the main discharge vessel Bd and the main discharge electrode E1 on the cathode side and between the inside of the main discharge vessel Bd and the main discharge electrode E2 on the anode side, a high voltage is applied, by which a dielectric barrier discharge is formed and by which ionization of the discharge medium is accelerated. In this way, starting of discharge is induced in the gap between the electrodes E1, E2.

The outside electrode Eu is on the outside of the auxiliary discharge vessel Bx. The high voltage generation part of a feed device which formed of a high voltage transformer and the like is connected such that between this outside electrode Eu and the outer lead A1 on the cathode side a high voltage is applied.

If, when the discharge lamp Ld is started, a high voltage is applied between the outside electrode Eu and the outer lead A1 on the cathode side, a high voltage is applied between the outside electrode Eu which is connected to the starting electrode Wt, the main discharge electrode E1 on the cathode side and the other outside electrode Ev which is connected to the metal foil 13 and the outer lead A1. In the auxiliary discharge space (Zx) within the auxiliary discharge vessel Bx, a dielectric barrier discharge is produced, light being emitted. This light travels to the discharge space for the main discharge which is formed within the arc tube part 10 and ionizes the discharge medium for the main discharge which is added inside.

When the discharge lamp Ld is turned off, a quite small part of the gas molecules in this lamp Ld are ionized by the UV radiation of the sun and natural radiation, by which electrons (also called initial electrons) are present. However, these electrons never ionize the gas molecules since the kinetic energy is low, even if they collide any number of times with the gas molecules. In doing so, if an electrical field is formed, the electrons between a collision with the gas molecules and the next collision with them are accelerated by the electrical field. Furthermore, in the case in which the time between these collisions is long enough, the electrons acquire sufficient kinetic energy. They ionize the gas molecules by the collisions with a certain probability and emit electrons. The electrons which have been formed in this way are also accelerated by the electrical field. When enough kinetic energy is acquired, some of the electrons again ionize the gas molecules. When such a chain reaction is repeated and when ionization of the gas molecules gradually continues, a state of insulation breakdown is reached. Since, a few minutes after turning off the lamp, the temperature is still high, the density of the gas molecules, such as of the mercury vapor or the like, is high. The frequency of collisions of the electrons with the gas molecules is therefore great (average duration between collisions is short). As a result, only a small portion of the electrons can acquire the kinetic energy which is necessary for ionization of the gas molecules. To induce an insulation breakdown in this case, the electrical field must necessarily be amplified. In doing so, if the arc tube part 10 is artificially exposed to UV radiation, the photoelectric effect and photoionization of the gas molecules cause formation of a large number of initial electrons with an absolute number which increases at the same ratio as the electrons which cause ionization. Therefore, at a relatively low electrical field, a state of insulation breakdown can be reached.

Therefore, both the formation of a dielectric barrier discharge between the inside of the main discharge vessel Bd and the main discharge electrode E1 on the cathode side or the main discharge electrode E2 on the anode side as well as formation of a discharge in the gap between the main discharge electrodes E1 and E2 are accelerated.

As a result, the start of the main discharge can be effectively induced, and consequently, the absolute value of the high voltage which is to be applied to the starting electrode Wt can be reduced.

Important points here are:

During operation of the discharge lamp Ld, no discharge takes place in the auxiliary discharge space (Zx), Since the auxiliary discharge vessel Bx is formed and installed non-integral with respect to the electrode sealing parts 11, 12 and the main discharge vessel Bd, the cooling rate of the auxiliary discharge space (Zx) after turning off the discharge lamp Ld is much greater than of the discharge space for the main discharge. The auxiliary discharge space (Zx) always has a much lower temperature than the discharge space for the main discharge.

The phenomenon that the voltage which is necessary for the insulation breakdown changes as a function of the temperature of the discharge space does not distinctly occur in the auxiliary discharge space (Zx). Therefore, under the condition of a hot restart in the auxiliary discharge space (Zx), a dielectric barrier discharge can be easily produced, and as a result, the time interval in which starting of the discharge lamp is impossible can be shortened.

As one specific electrical circuit for implementation of the invention, the same circuit can be used as in the technology which is described in Japanese patent application 2002-2317 noted above. It is described below.

Figure 6:
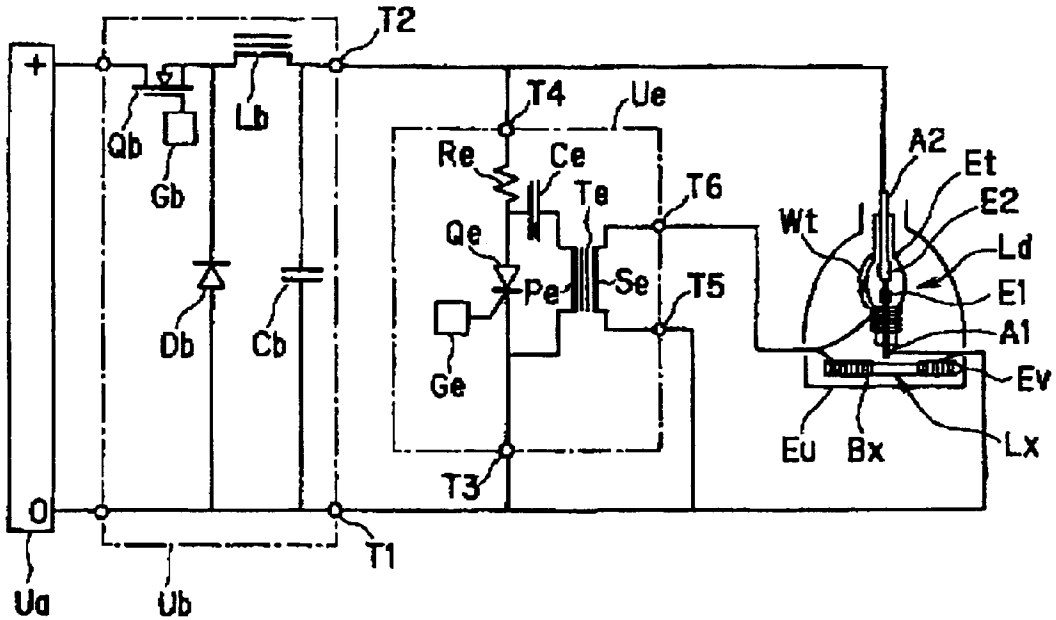
FIG. 6 is a simplified representation of one example of a circuit which operates the light source device according to a first version using a feed device of the DC driving type.

FIG. 6 shows one example, in a simplified representation, of a circuit which drives the light source device in the version as shown in FIGS. 1 to 3, using a feed device of the DC driving type. Here, a feed circuit Ub is connected to a DC source, such as a PFC (Power factor corrector) or the like, as the driving current source. The outside leads A1, A2 of the discharge lamp Ld are connected to the output terminals T1, T2 of the feed circuit Ub.

In the Figure, a feed circuit UB of the voltage reduction chopper type is shown by way of example. Here, the current from the DC source Ua is turned on and off by a switching device Qb, such as a FET or the like. When the switching device Qb is in the ON state, a smoothing capacitor Cb is charged from the DC source Ua via a reactor Lb and the discharge lamp Ld is supplied with current. When the switching device Qb is in the OFF state, the smoothing capacitor Cb is charged via a diode Db by the induction action of the reactor Lb. A gate signal with a suitable pulse duty factor is delivered to the switching device Qb from a gate driver circuit Gb such that the discharge current flowing between the electrodes E1, E2 for the main discharge (hereinafter called "main discharge electrodes") of the discharge lamp Ld, the voltage between the main discharge electrodes E1, E2 or the lamp wattage is a product of this current and this voltage has a suitable value which corresponds to the state of the discharge lamp Ld at the respective instant.

Normally, for suitable control of the above described lamp current, the above described lamp voltage or the above described lamp wattage, there is a resistor divider or a shunt resistor for determining the voltage of the smoothing capacitor Cb and the current which is supplied to the discharge lamp Ld. Furthermore, normally there is a control circuit which makes it possible for the gate driver circuit Gb to produce a suitable gate signal. However, they are not shown in FIG. 6.

In the case of operation of the discharge lamp Ld, before starting, the above described no-load voltage is applied between the main discharge electrodes E1, E2 of the discharge lamp Ld. Since the input point T4 and the ground point T3 of the starter Ue are connected in parallel to the discharge lamp Ld, the same voltage as the voltage applied to the discharge lamp Ld is also supplied to the starter Ue. When this voltage is received, at the starter Ue, a capacitor is charged via a resistor Re.

By closing the switching device Qe, such as a SCR thyristor or the like, by a gate driver circuit Ge with suitable timing, the charging voltage of the capacitor Ce is applied to the primary winding Pe of a high voltage transformer Te. In the secondary winding Se of the high voltage transformer Te, therefore an increased voltage forms which corresponds to the arrangement of the high voltage transformer Te. In this case, the voltage which has been applied to the primary winding Pe decreases quickly according to the discharge of the capacitor Ce. Therefore, the voltage which forms in the secondary winding Se likewise decreases rapidly. As a result, the voltage which forms in the secondary winding Se becomes a pulse.

One end of the secondary winding Se of the high voltage transformer Te is connected via the output terminal T5 of the starter Ue to one of the main discharge electrodes in the discharge lamp Ld, specifically to the main discharge electrode E1 (electrode on the cathode side in this embodiment), and to the second outside electrode Eu of the auxiliary light source Lx. The other end of the secondary winding Se of the high voltage transformer Te is connected via the output terminal T6 of the starter Ue to the starting electrode Et which is located outside the main discharge vessel Bd of the discharge lamp Ld and to the first outside electrode Eu of the auxiliary light source Lx. The high voltage which forms in the secondary winding Se of the high voltage transformer Te produces a discharge in the auxiliary discharge space Zx of the auxiliary light source Lx (i.e., between the areas of the insides of the auxiliary discharge vessel Bx which are opposite the first and the second outside electrodes Eu and Ev of the auxiliary light source Lx, the dielectric of the auxiliary discharge vessel Bx being clamped).

The light which has been formed in this way from the auxiliary light source Lx accelerates the photoelectric effect within the main discharge vessel, thus also accelerates the formation of a dielectric barrier discharge between the inside of the main discharge vessel Bd and the cathode E1 and between the inside of the main discharge vessel Bd and the anode E2, and moreover, accelerates the insulation breakdown in the gap between the electrodes E1 and E2 for the main discharge. As a result, the absolute value of the high voltage which is to be applied to the above described conductive wire Wt can be reduced.

The specific electrical circuit for implementing the invention is not limited to the version described above, and the nature of various other circuits will be apparent. For example, a respective operating circuit can be provided in each of the auxiliary discharge vessel and the main discharge vessel. In this way, an optimum high voltage can be applied to the respective discharge vessel, by which reliable operation is enabled.

As was described above, in accordance with the invention, the auxiliary discharge vessel is installed between the reflector and the window component and is not in contact with the main discharge vessel. Therefore, it is rarely influenced by the main discharge vessel, even if the main discharge vessel reaches a high temperature. The disadvantage of a high breakdown voltage due to the increase of gas pressure as a result of heating of the auxiliary discharge vessel is therefore avoided. The start of discharge within the auxiliary discharge vessel is also facilitated when operation of the discharge lamp is restarted. As a result, prompt generation of a discharge within the main discharge vessel is enabled. Thus, a light source device with an advantageous starting property of the discharge lamp can be made available.

Even in the case in which the discharge lamp is made even smaller, the dimensions of the auxiliary discharge vessel are not limited by the reduction in size. Therefore, the disadvantage of difficulties in its manufacture can be avoided. In this way, an auxiliary light source with high quality can be provided, and for this auxiliary light source, the breakdown voltage can be kept low, by which operation can be guaranteed. As a result, a light source device with a permanently good starting property can be achieved. Furthermore, the auxiliary discharge vessel is clamped between the reflector and the window component and is thus held tightly. Therefore, this auxiliary light source can be easily mounted in the light source device. As a result, the light source device acquires high reliability with respect to vibration resistance and impact strength, and it becomes possible to advantageously use the light source device for the purpose of a liquid crystal projector device.

Figure 7:
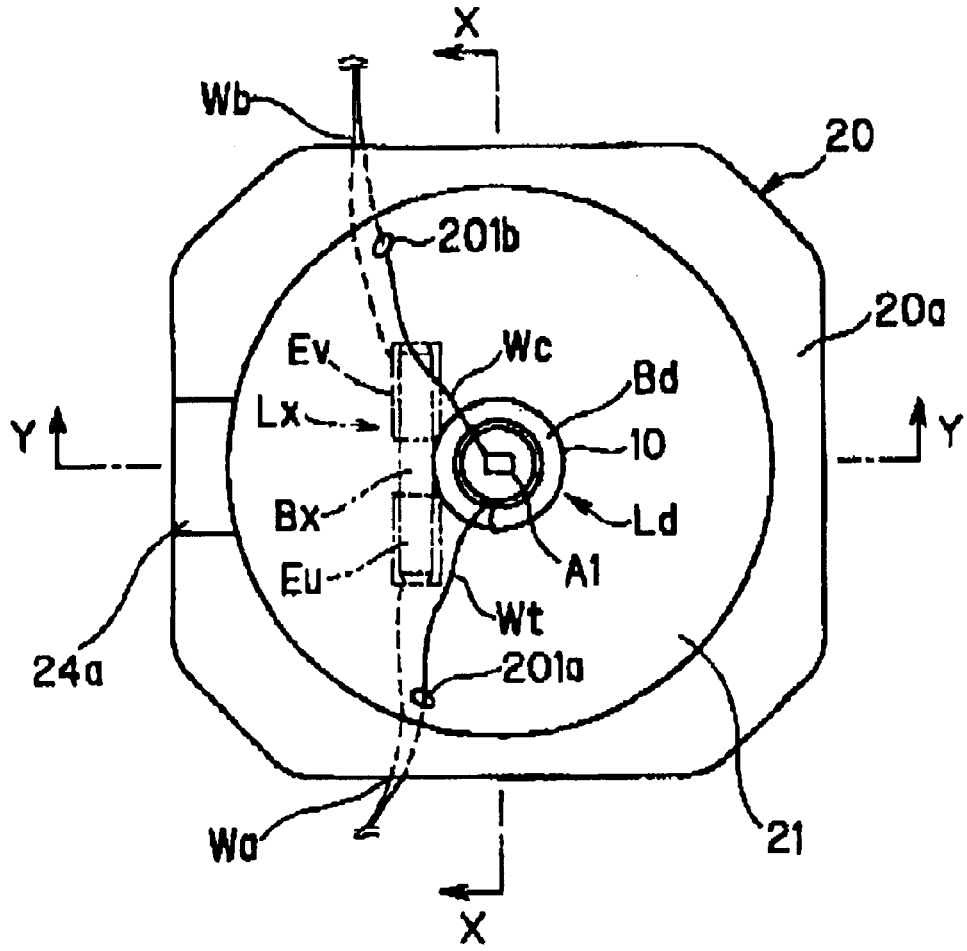
FIG. 7 is a schematic cross section of a second version of the invention.
Figure 8:
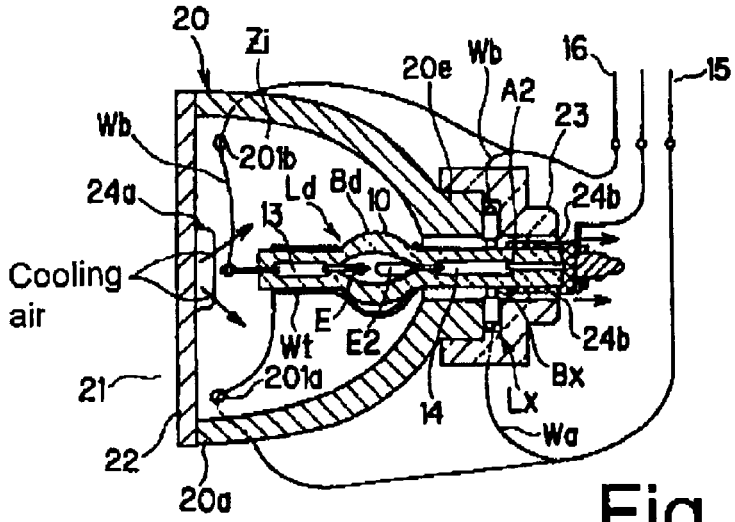
FIG. 8(*a*) is a schematic cross-sectional view taken along line X—X in FIG. 7.
Figure 8:
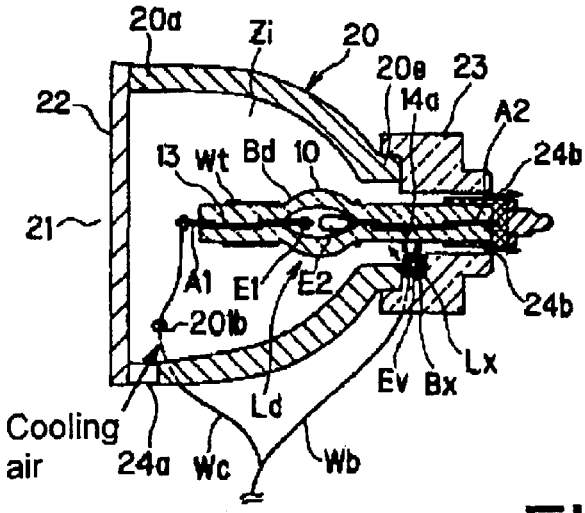

FIG. 7 shows a schematic front view of the reflector and the discharge lamp in the light source device according to a second embodiment of the invention with the window component omitted. FIGS. 8(*a*) & 8(*b*) show schematic cross-sectional views taken along the lines X—X and Y—Y, respectively, in FIG. 7. In FIGS. 7, 8(*a*) & 8(*b*), the same parts as in the embodiment FIG. 1 to FIG. 4(*a*) & 4(*b*) and FIG. 6 are provided with the same reference numbers and are not further described.

In the second embodiment, the auxiliary light source Lx is attached by means of a cement or the like and is held tightly in a base 23 which is installed in the neck area 20*e* of the reflector 20. In this auxiliary light source Lx, part of the auxiliary discharge vessel Bx comprising the auxiliary light source Lx is located opposite the interior Zi of the reflector. The UV radiation which has been emitted from this auxiliary light source Lx thus travels to the main discharge vessel Bd. In the base, at the point which is opposite the auxiliary discharge vessel, a diffusion reflection surface is formed with a diffusion reflection factor with respect to UV radiation with wavelengths from 170 nm to 300 nm which is greater than or equal to 10%. In this way, UV radiation which has been emitted by this auxiliary light source Lx in the direction toward the base 23 can be reflected in the direction to the main discharge vessel Bd. The amount of light which is directed toward the main discharge vessel increases, by which the photoelectric effect within the main discharge vessel is intensified and by which it becomes possible to more reliably start the main discharge vessel.

The following can be expected:

In the case in which, for example, the size of the main discharge vessel (Bd) remains unchanged and in which, with respect to the optical properties, a large reflector (20) must be used, in the arrangement in which the auxiliary light source (Lx) is located in the vicinity of the edge area (20*a*) of the opening in front of the reflector (20), as in the above described light source device according to the first embodiment, the auxiliary light source (Lx) is away from the discharge lamp (Ld). In this way, the UV radiation (with wavelengths of roughly 200 nm to 275 nm) from the auxiliary light source (Lx) no longer simply reaches the main discharge vessel (Bd). In this way, the starting property of the discharge lamp (Ld) is adversely affected.

In the second version, which is shown in FIGS. 7 to 8(*a*) & 8(*b*), the auxiliary light source Lx is located in the vicinity of the neck area 20*e* of the reflector 20. That is, the auxiliary light source Lx is always located in the vicinity of the main discharge vessel Bd. In this way, the amount of UV radiation which is incident in this main discharge vessel Bx is prevented from decreasing. Thus, the discharge lamp Ld can be reliably operated.

Here, it is advantageous that the auxiliary discharge vessel Bx is arranged such that the UV radiation from the auxiliary light source Lx is incident at least in a wide area 14*a* of the metal foil 14 which is installed in the electrode sealing part 11 of the main discharge vessel. In this case, the arrangement is such that, on a wide area 14*a* and in the electrode sealing part 12, asymmetric reflection and critical reflection form, that the amount of incidence of the UV radiation which reaches the main discharge vessel Bd increases and that the probability of starting a discharge of the discharge lamp Ld increases. In this way, various types of reflection occur when the UV radiation is incident at least in a wide area 14*a* of the foil, even if in this arrangement the UV radiation from the auxiliary light source Lx is not directly incident in the arc tube part 10 of the main discharge vessel Bd. As a result, this UV radiation can reach the arc tube part 10 of the main discharge vessel Bd and it starts to contribute to an improvement of the starting property. This effect of course is not limited to the configuration in which the auxiliary light source Lx is held by the base 23.

In FIGS. 7 to 8(*a*) & 8(*b*), ventilation openings 24*a*, 24*b* for passage of cooling air into the interior Zi of the reflector are provided. Cooling air flows through the ventilation opening 24*a* which is formed in the edge area 20*a* of the opening at the reflector 20, as is shown, for example, in FIGS. 8(*a*) & 8(*b*) by arrows. Here, the cooling air in the interior Zi of the reflector cools the discharge lamp Ld and is discharged from the ventilation opening 24*b* which is located in the base 23. As is shown in FIGS. 8(*a*) & 8(*b*), as the cooling air passes through, the auxiliary discharge vessel Bx is cooled, when a ventilation opening 24*b* is formed in the vicinity of the auxiliary light source Lx. Therefore, the temperature of the auxiliary discharge vessel Bx is prevented from increasing, and thus, an increase of the internal gas pressure can be suppressed and an increase in the value of the breakdown voltage can be prevented. In this way, the starting voltage of the auxiliary discharge vessel can be kept low.

In the case in which the auxiliary light source (Lx) is located in front of the reflector 20 on the side of the edge area (20*a*) of the opening, as in the first embodiment which was described above and shown in FIGS. 1 to 3, a ventilation opening can be provided in the vicinity of the auxiliary discharge vessel (Bx).

According to the above described second version, the auxiliary discharge vessel is held tightly by the base without contact with the main discharge vessel. It is therefore never directly subject to the heat from the main discharge vessel. According to the temperature increase of the auxiliary discharge vessel, the increase of the breakdown voltage is therefore suppressed. Thus, the operating property of the auxiliary light source is good. As a result, it becomes possible to devise a light source device which can reliably carry out restarting of the discharge of the discharge lamp. Since the size and the shape of the auxiliary discharge vessel are, of course, not limited by the dimensions and the like of the electrode sealing parts of the main discharge vessel, it can thus become possible to avoid the disadvantage of difficult manufacture of the auxiliary discharge vessel as a result of its extreme reduction in size. Furthermore, the light source device, as in the first embodiment, acquires high reliability with respect to vibration resistance and impact strength. Therefore, it becomes possible to advantageously use the light source device for the purpose of a liquid crystal projector device.

Figure 9:
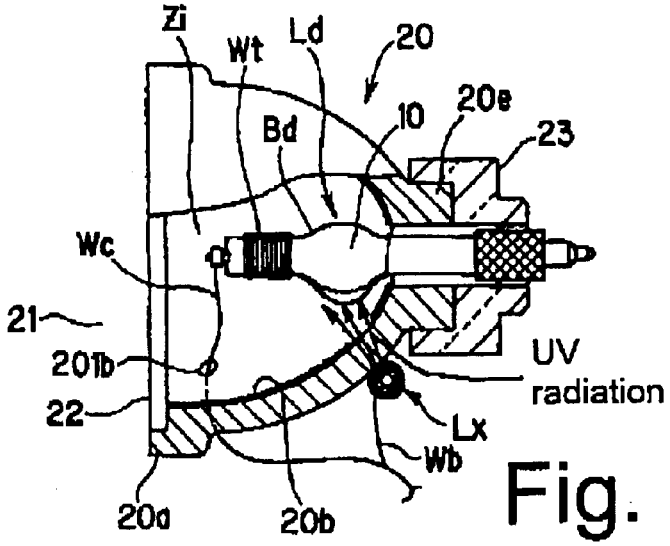
FIGS. 9(*a*) & 9(*b*) each show a schematic representation of a third version of the invention.
Figure 9:
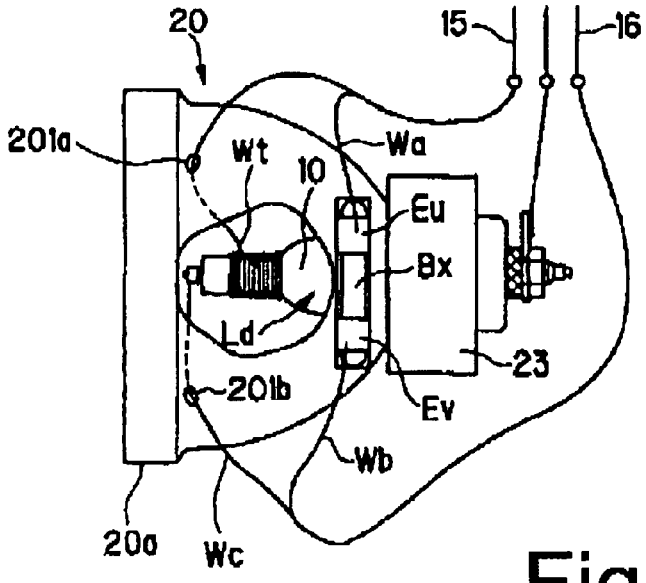

FIG. 9(*a*) & 9(*b*) each show a third embodiment of the invention. The same parts as in FIGS. 1 to 4 and as in FIG. 6 to FIG. 8(*a*) & 8(*b*) are provided with the same reference numbers as in these figures and are not further described.

The third embodiment is an example of a light source device in which the auxiliary discharge vessel Bx is located on the outside surface of the reflector 20. FIG. 9(*a*) is a partial cross section-side view of the light source device. FIG. 9(*b*) is a side view in which the light source device as shown in FIG. 9(*a*) is viewed from underneath in the page and is partially extracted.

For the reflector 20, a material is used with a transmission factor for radiant light from the auxiliary light source Lx, for example, for light with wavelengths from 200 nm to 275 nm, of at least 50%, such as, for example, silica glass. On the inside of the reflector 20, the reflection surface 20*b* is formed from a multilayer dielectric film. This reflection surface 20*b* has a reflection property for visible radiation. However, it has a low reflection factor and a low degree of absorption for UV radiation, i.e., a high transmission factor for UV radiation. The UV radiation 20 from the auxiliary light source Lx is therefore transmitted by the silica glass comprising the body of the reflector 20 and by the reflection film which forms the reflection surface 20*b* as the inside of the reflector body, travels to the interior Zi of the reflector, is incident in the main discharge vessel Bd and begins to contribute to the start of discharge of the discharge lamp Ld.

Since the auxiliary discharge vessel Bx is located outside of the reflector 20, it is hardly exposed to the heat from the main discharge vessel Bd. Thus, heating is prevented. Therefore, the auxiliary discharge vessel Bx can also be mounted on the reflector 20 by means of a cement or the like.

By the light source device according to the above described third embodiment, by the arrangement of the auxiliary discharge vessel outside the reflector with UV translucency, it is possible to prevent the temperature of this auxiliary discharge vessel from increasing. Thus, an increase of the internal gas pressure can be prevented. In this way, it is possible to prevent an increase of the breakdown voltage of this auxiliary light source. The location of the auxiliary light source acquires a greater degree of freedom. The limitation with respect to size, shape and the like of the auxiliary discharge vessel is greatly reduced. It becomes possible to produce the auxiliary discharge vessel in an extremely simple manner. The most advantageous point in this embodiment is to enable the auxiliary discharge vessel to be located at a point with high incidence efficiency for UV light which is opposite the main discharge vessel and that, in this way, the amount of UV light for the main discharge vessel can be increased. Furthermore, if in the optical path between the main discharge vessel and the auxiliary discharge vessel, part of the multilayer dielectric film comprising the reflection surface is eliminated so that it can be directly opposite the main discharge vessel, this effect can be increased even more.

Figure 10:
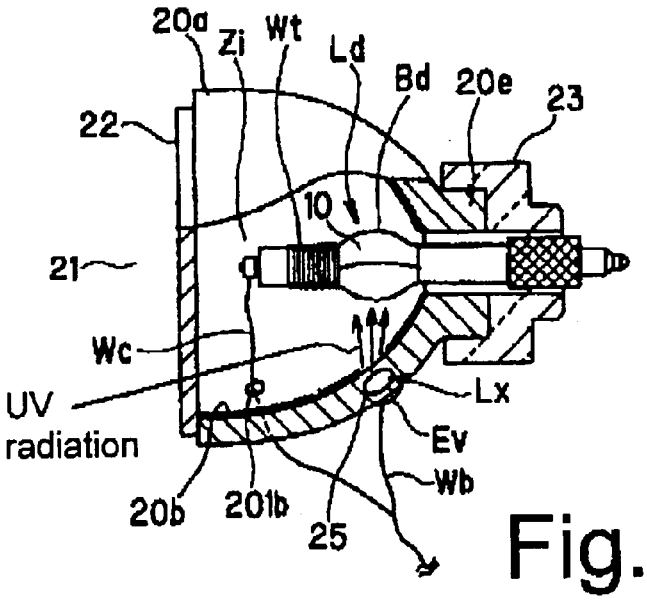
FIGS. 10(*a*) & 10(*b*) each show a schematic representation of a fourth version of the invention.
Figure 10:
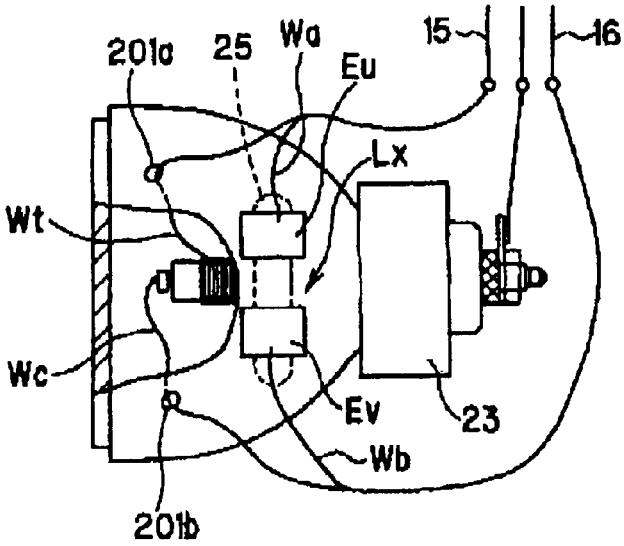

FIGS. 10(*a*) & 10(*b*) each show a fourth embodiment of the invention in a schematic. In FIGS. 10(*a*) & 10(*b*), the same parts as FIGS. 1 to 4(*a*) & 4(*b*), and FIGS. 6 to 9(*a*) & 9(*b*) are also provided with the same reference numbers as FIGS. 1 to 4(*a*) & (*b*) and FIGS. 6 to FIG. 9(*a*) & 9(*b*) and are not further described. FIG. 10(*b*) is a side view in which the light source device as shown in FIG. 10(*a*) is viewed from underneath and is partially extracted.

In this embodiment, in the body of the reflector 20, the auxiliary light source Lx is formed. The reflector 20, for example, of silica glass in which a bubble part 25 is formed. On the outside of the reflector 20, at a point corresponding to the bubble part 25, a pair of outside electrodes Eu, Ev are formed by the conductive components being cemented by means of a conductive cement or the like or by similar methods. Lines Wa, Wb are connected to the respective outside electrodes Eu, Ev. The line Wa which is connected, for example, to outside electrode Eu, is connected to the starting electrode Wt. The line Wb, which is connected to the other outside electrode Ev, is connected to a line Wc which is connected to the electrode E1 on the cathode side. These lines Wa, Wb are connected to terminals 15, 16 and are connected to the current supply line of the outside current source (not shown).

If current is supplied from the outside current source, a discharge forms within the bubble part 25, by which UV radiation is obtained which is transmitted by the silica glass comprising the reflector 20, which travels to the interior Zi of the reflector and which is incident in the main discharge vessel Bd. As a result, the same action and the same effect as in the above described other embodiments are obtained. The auxiliary light source is located in the reflector by this light source device according to the fourth embodiment of the invention. The disadvantage of the auxiliary discharge vessel falling out of the light source device never occurs either. Furthermore, because the auxiliary light source Lx is installed without contact with the discharge lamp Ld in the light source device, the arrangement of the light source device can be simplified.

As was described in the above described third embodiment, the above described effect can be further enhanced by eliminating part of the multilayer dielectric film so that the auxiliary discharge vessel is directly opposite the main discharge vessel.

If, in the above described embodiment, in part of the radiation window of the auxiliary discharge vessel, a material with a degree of diffusion-reflection for radiant light from the auxiliary discharge vessel, for example, for light with wavelengths from 200 nm to 275 nm, of at least 10%, such as, for example, an inorganic cement, with aluminum oxide or silica gel as the main component, or a multilayer dielectric film of titanium oxide, is formed, the efficiency for feeding radiant light from the auxiliary discharge vessel into the main discharge vessel can be increased. Therefore, the starting property of the discharge lamp can be increased even more.

In the above described embodiment, mainly a case of the DC driving type was described. However, the invention also works equally effectively in the case of an AC driving type. In the discharge lamp for a DC driving type, there are a cathode and an anode individually with respect to the electrodes of the two poles for the main discharge, while in a discharge lamp for the AC driving type, the relation between the cathode and anode is not fixed, and for example, the electrodes of the two poles have the same arrangement. The discharge lamp for an AC driving type therefore differs with respect to the arrangement of the above described body of the discharge lamp from the discharge lamp for a DC driving type. However, such a difference has essentially nothing to do with the action and the effect of the invention.

ACTION OF THE INVENTION

By the invention, the discharge vessel of the auxiliary light source is held tightly without contact with the main discharge vessel by the reflector and/or the component in its vicinity and is mounted in the light source device. Therefore, a light source device with high reliability with respect to vibration resistance and impact strength can be made available, the following advantages being obtained:

- The operating characteristic of the auxiliary light source can be improved. The starting property within the main discharge vessel is extremely good.
- The disadvantage of a complicated arrangement and high costs of the light source device can be avoided.
- A reduction of the proportion of good articles in the manufacture of products and a reduction in the quality of the discharge lamp are prevented.

Furthermore, in accordance with the invention, on the outside of the auxiliary discharge vessel of the auxiliary light source, there are a first outside electrode and a second outside electrode at a distance to one another in accordance with the relationship:

$$A \leq D \leq 15A$$

where A (kV) is the starting voltage of the auxiliary light source and D (mm) is the distance between the first outside electrode and the second outside electrode.

Therefore the auxiliary light source can be reliably operated.

What is claimed is:

1. Light source device, comprising:

a discharge lamp within a main discharge vessel which is filled with a discharge medium, and having a pair of opposed main discharge electrodes, one of the main discharge electrodes being held in a first electrode sealing part at one end of the discharge vessel and the other of the electrodes being held in a second electrode sealing part at an opposite end of the main discharge vessel, a reflector which reflects radiant light from the discharge lamp by means of a reflection film which has been formed on an inner side of the reflector, light being reflected in a direction toward a light exit window formed in a front end of the reflector, and a starting electrode located outside of the main discharge vessel, an auxiliary light source which has an auxiliary discharge vessel which is filled with a discharge medium, a first outside electrode on an outer side of the auxiliary discharge vessel and electrically connected to the starting electrode, said auxiliary light source being mounted in the area of the reflector and without contact with the main discharge vessel.

2. Light source device as claimed in claim 1, wherein the auxiliary light source is attached to at least one of the above described reflector and at least one part which is adjacent to the reflector.

3. Light source device as claimed in claim 1, wherein the auxiliary discharge vessel is located in the vicinity of an edge area of the light exit window of the reflector.

4. Light source device as claimed in claim 3, wherein a translucent window component is installed in the reflector in such a way that an edge area of the light exit window is closed, and wherein the auxiliary discharge vessel is installed between the window component and the reflector.

5. Light source device as claimed in claim 1, wherein a base is installed in a neck area of the reflector and the auxiliary discharge vessel is held by the base.

6. Light source device as claimed in claim 1, wherein the auxiliary discharge vessel is located on an outer side of the reflector.

7. Light source device as claimed in claim 1, wherein said first outside electrode and said second outside electrode are positioned at a distance from one another in accordance with the relationship:

$$A \leqq D \leqq 15A$$

where A (kV) is the starting voltage of the auxiliary light source and D (mm) is the distance between the first outside electrode and the second outside electrode.

* * * * *